US005786759A

United States Patent [19]

Ling

[11] Patent Number: 5,786,759

[45] Date of Patent: Jul. 28, 1998

[54] ALARMING WIRE LOCK

[76] Inventor: Chong-Kuan Ling, P.O. Box 96-156, Taipei, Taiwan

[21] Appl. No.: 856,748

[22] Filed: May 15, 1997

[51] Int. Cl.[6] ..... E05B 45/06

[52] U.S. Cl. ..... 340/542; 70/30; 70/DIG. 49

[58] Field of Search ..... 340/542, 543, 340/529, 568, 571; 70/DIG. 49, 432, 439, 286, 315, 22, 30

[56] References Cited

U.S. PATENT DOCUMENTS

| | | | |
|---|---|---|---|
| 4,896,517 | 1/1990 | Ling | 70/30 X |
| 5,191,314 | 3/1993 | Ackerman et al. | 340/542 |
| 5,406,257 | 4/1995 | Saito | 340/542 |
| 5,598,727 | 2/1997 | White | 70/233 |

*Primary Examiner*—Thomas J. Mullen, Jr.

[57] ABSTRACT

An alarming wire lock includes an alarm circuit provided in the wire lock having a self-retractable wire wound in the lock casing and outwardly pulled to lock a thing by fastening the wire on the thing, whereby upon cutting of the wire or upon vibration of the thing, the alarm circuit will be actuated for sounding for safety warning.

7 Claims, 5 Drawing Sheets

ALARMING WIRE LOCK

BACKGROUND OF THE INVENTION

This application is an improvement of U.S. Pat. No. 4,896,517 (hereinafter called "the original invention") patented on Jan. 30, 1990 also granted to the same inventor of this application.

The original invention disclosed a wire lock including a push-button latch operatively locking a locking head of a wire rope wound in a lock casing, and operatively depressed for disengaging the locking head of the wire rope when opening the lock so that the wire rope can be automatically retracted into the lock casing.

However, the original invention did not provide an alarm means in the wire lock. An intruder, even not understanding the unlocking combination of the wire lock locked on a thing, may cut the wire of the lock to steal the thing easily.

The inventor has now improved this drawback by providing an alarm means in the wire lock for a sounding alarming purpose for the wire lock.

SUMMARY OF THE INVENTION

The object of the present invention is to provide an alarming wire lock including an alarm circuit provided in the wire lock having a self-retractable wire prewound in the lock casing and outwardly pulled to lock a thing by fastening the wire on the thing, whereby upon cutting of the wire or upon vibration of the thing, the alarm circuit will be actuated for sounding for safety warning.

DETAILED DESCRIPTION

Figure 1:
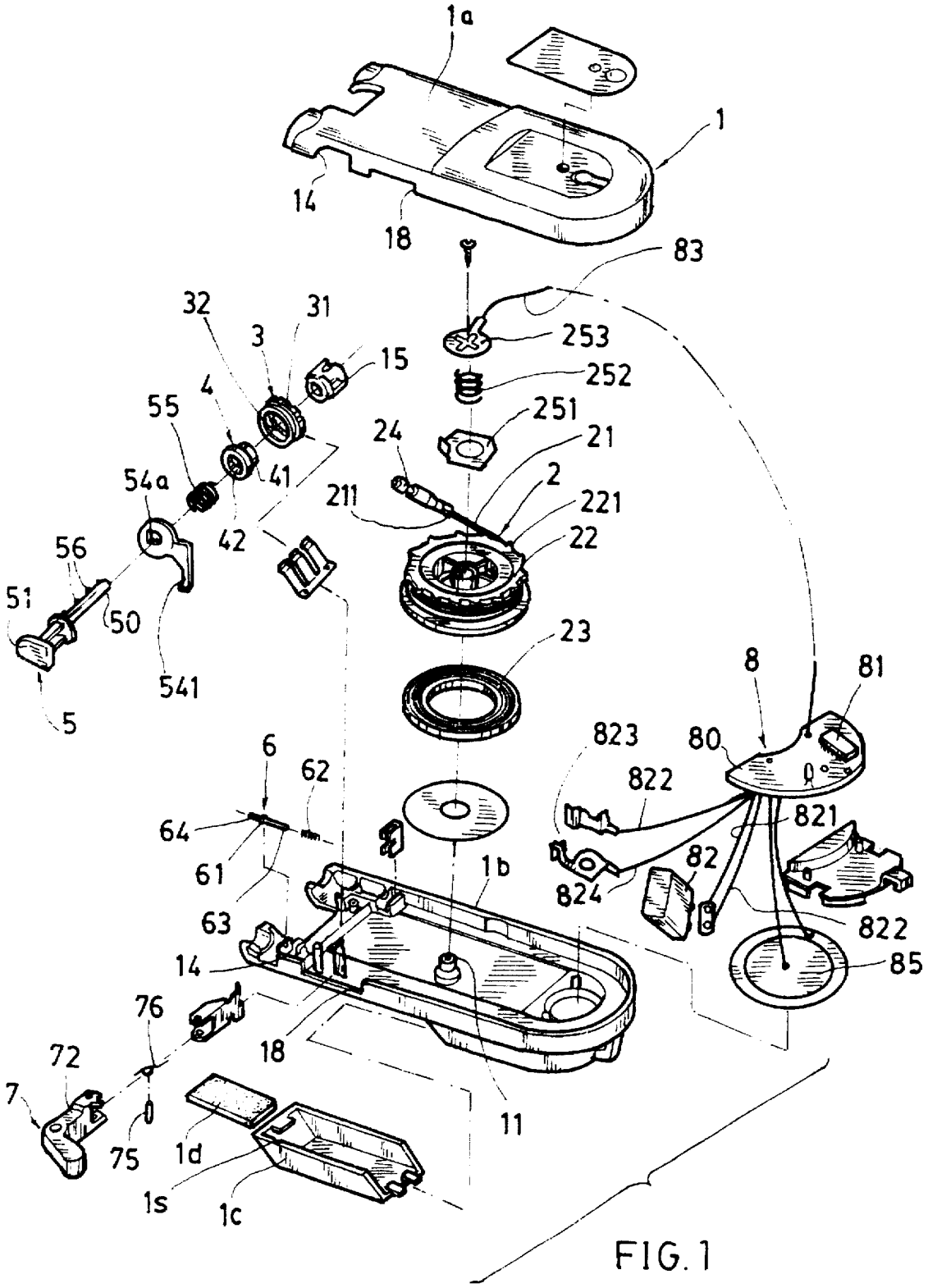
FIG. 1 is an exploded view of the elements of the present invention.

As shown in the drawing figures, an alarming wire lock of the present invention comprises: a casing 1 consisting of a front cover 1*a* and a rear cover 1*b*, a wire means 2, a plurality of dials 3, a plurality of sleeves 4, a push-button latch 5, a resilient impinger 6, a wire clutch means 7, and an alarm circuit 8.

The alarm circuit 8 may include an audible alarm such as a buzzer or other alarms with audible and visual alarming functions, not limited in the present invention.

Figure 4:
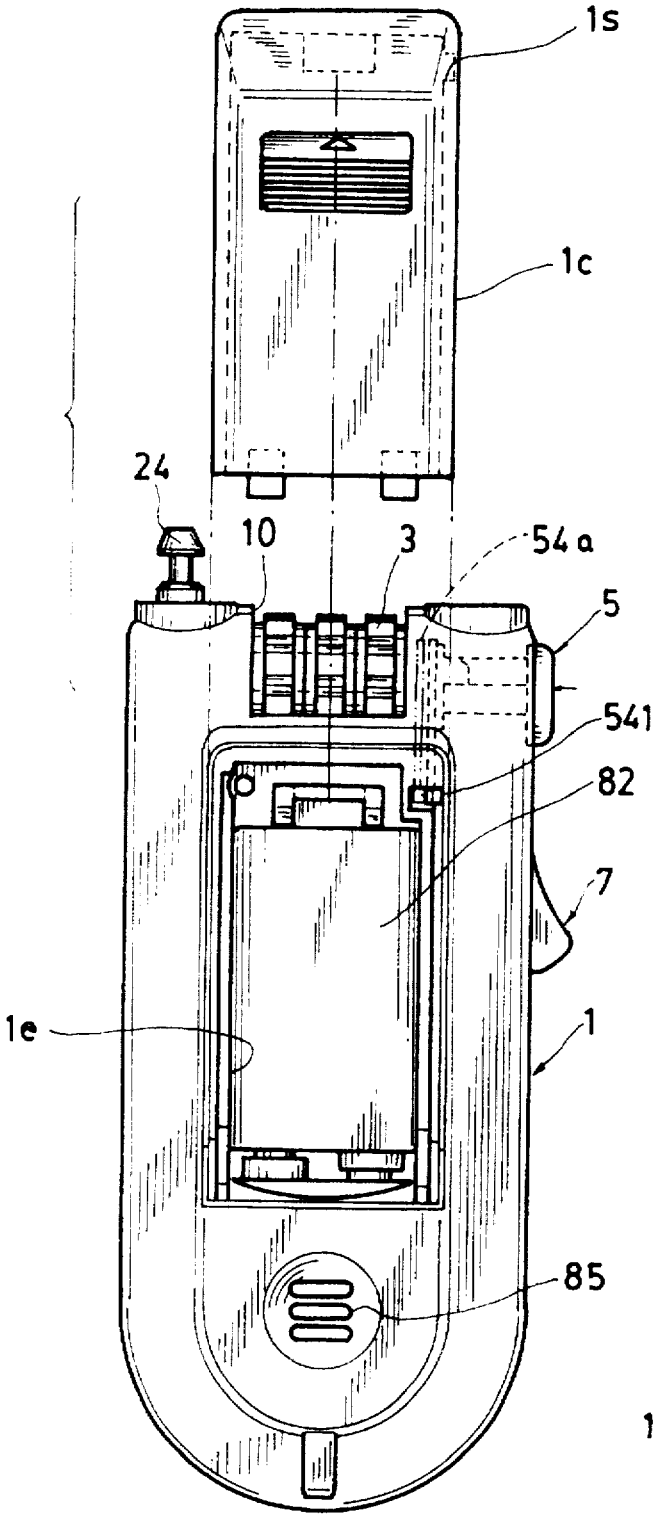
FIG. 4 is a rear view when removing a battery cover of the present invention.
Figure 5:
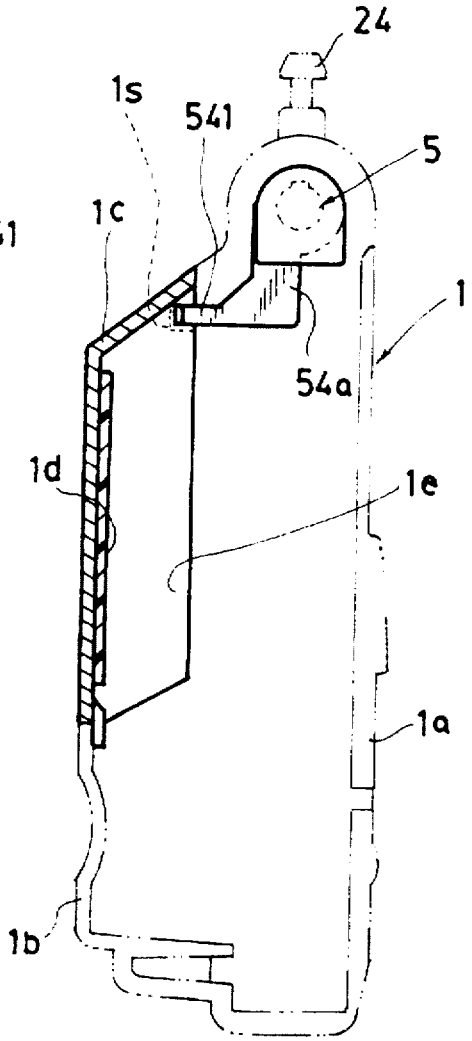
FIG. 5 is a partial side view of the present invention showing a battery chamber and its cover.

The casing 1 includes: a spindle 11 provided at a central location of the casing 1 for rotatably mounting the wire means 2, a right hole 12 formed in an upper right portion of the casing 1 for resting a locking head 24 of the wire means 2 when unlocked, a left hole 13 formed in an upper left portion of the casing 1 to lock the locking head 24 at its locking position, a horizontal latch hole 14 transversely formed in an upper portion of the casing 1, a sliding block 15 slidably held in a right portion in the latch hole 14 and located in between the sleeves 4 and the locking head 24 when rested in the right hole 12, an upper slot 10 cut out in an upper portion of the casing 1 for providing the dials 3 therein, an impinger seat 16 recessed in an upper left portion of the casing 1 for holding the impinger 6 thereon, a lower push-button pin 17 fixed in a middle portion of the casing 1 for pivotally securing a lower push-button 71 of the wire clutch means 7, a lower push-button hole 18 formed in a left portion of the casing 1 for depressing the lower push-button 71, and an alarm circuit chamber 19 located in a lower portion of the casing 1 for installing the alarm circuit 8 in the chamber 19. The rear cover 1*b* is formed with a battery cover 1*c* for covering a battery chamber 1*e* wherein at least a battery 82 of a power source of the alarm circuit 8 is stored as shown in FIGS. 4, 5.

The wire means 2 includes: a wire rope 21 wound on a reel 22 rotatably mounted on the spindle 11, a coil spring 23 resiliently rewinding the wire rope 21 on the reel 22, and a locking head 24 secured to an outermost end of the wire rope 21. The reel 22 includes a plurality of ratchet teeth 221 circumferentially formed on a periphery of a reel disk slidably slipping from a pawl 73 of the wire clutch means 7 when the reel 22 is rotated clockwise, and operatively retarded by the pawl 73 when rotated counter-clockwise.

The wire rope 21 has an inner end 212 which is electrically connected to the alarm circuit 8 through a rotary connector 25 as shown in FIGS. 2, 3, 8 and 9.

Each dial 3 includes an outer annular ring 31 having a plurality of numbers 0, 1, 2, . . . 9 circumferentially formed on the ring 31, and an inner hole 32 having a plurality of grooves annularly formed in each dial to be engageable with a tooth 41 formed on an outer periphery of each sleeve 4.

Each sleeve 4 includes: a plurality of teeth 41 circumferentially formed on a periphery of the sleeve 4, a central hole slidably engageable with a cylindrical rod 52 of the push-button latch 5, a recess 42 recessed in a bore of the central hole of the sleeve 4 to be engageable with a key 56 protruded from the cylindrical rod 50 of the latch 5, with an outermost left sleeve 4 formed with a spring recess in the sleeve for retaining a restoring spring 55 of the push-button latch 5.

The push-button latch 5 includes: a push button 51 provided at a left side of the casing 1 having a vertical hole 52 formed in a left portion of the latch 5 for inserting the locking head 24 of the wire means 2 through the vertical hole 52, a locking extension 53 formed on a left portion of the latch 5 having a sloping portion of the extension 53 formed on a right side of the vertical hole 52 to thrust the latch 5 rightwardly when downwardly driven by the locking head 24 until the locking head 24 is located on a right-angle portion formed on a lower portion of the locking extension 53 (FIG. 3), a spring retarding plate 54*a* formed on the latch 5 at a right side of the locking extension 53 for retaining the restoring spring 55 jacketed on the latch 5 with a right spring end resilient urging the sleeves 4 to be engaged with the dials 3 and a left spring end of the restoring spring 55 urging the retarding plate 54*a* to protrude the push button 51 leftwardly outwardly beyond the latch hole 14, and the cylindrical rod 50 slidably engageable with a central hole of each sleeve 4 having a right end of the rod 50 poking into the sliding block 15.

The resilient impinger 6 includes: a flange 61 circumferentially formed on a middle portion of the impinger 6 and retained on a tensioning spring 62 normally retained on the impinger seat 16, a lower impinger portion 63 protruding downwardly from the flange 61 and disposed within the tensioning spring 62 to movably pass through a lower impinger hole 162 formed through the impinger seat 16, and an upper impinger portion 64 protruding upwardly from the flange 61 to movably pass through an upper impinger hole 161 formed in an upper left portion of the casing above the lower impinger hole 162.

The wire clutch means 7 includes: a lower push button 71 pivotally secured in a button hole 18 in the casing 1 by a pin 17, a lever 72 protruding rightwardly from the lower push button 71 having a pawl 73 protruding downwardly from the lever 72 for engaging or slidably disengaging the ratchet teeth 221 of the wire reel 22, a lug 74 protruding upwardly from the lever 72 to be operatively retarded by the lower impinger portion 63 of the impinger 6 as lowered when the wire lock is locked by inserting the locking head 24 into the left hole 13 to depress the impinger 6 downwardly (FIG. 3) to thereby retard the depression of the lower push button 71, and a restoring spring 76 disposed on a pin 75 for normally urging the lever 72 and the pawl 73 to be engaged with the ratchet tooth 221 of the reel 22. The wire clutch means 7 controls a rewinding of the wire rope 21 on the reel 22 or releasing of the wire rope unwound from the reel.

Figure 8:
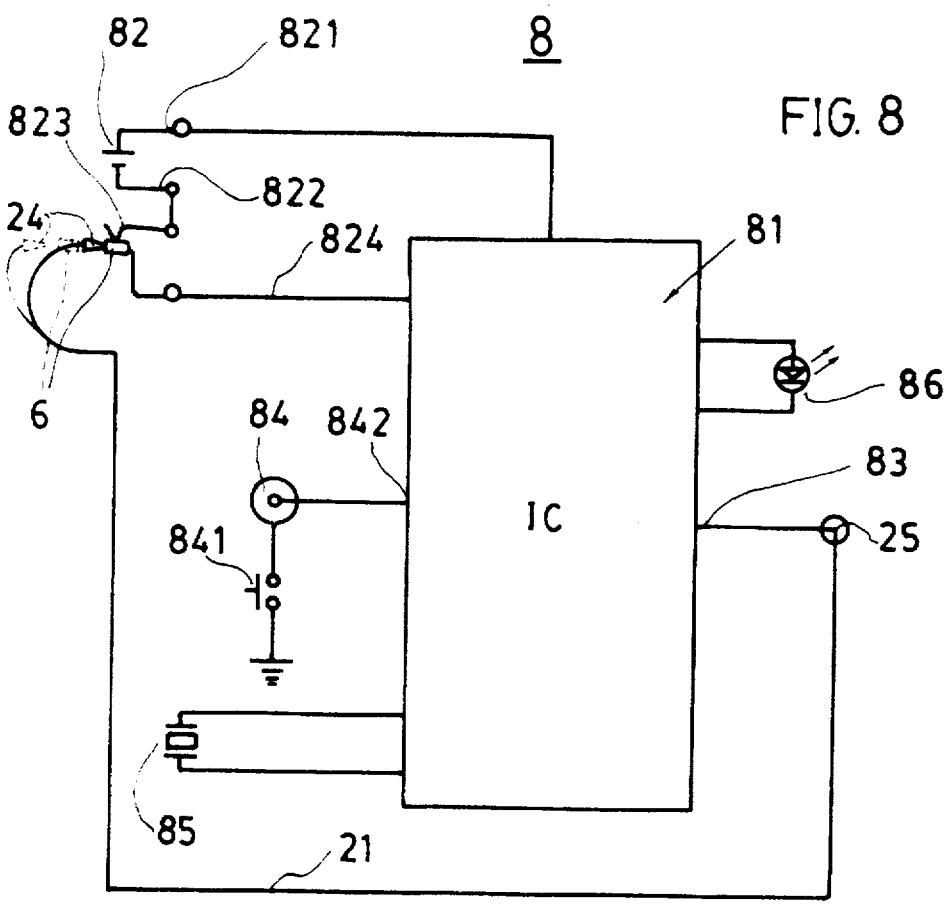
FIG. 8 shows an alarm circuit of the present invention.

The alarm circuit 8 is shown in FIG. 8 and a preferred embodiment of the circuit 8 is described hereinafter, which however may be otherwise modified, not limited to this detailed circuit as illustrated herewith.

The alarm circuit 8 includes: an alarm integrated circuit (IC) 81 secured on a circuit board 80 installed in the alarm circuit chamber 19 in the casing 1 for processing an input alarm signal and for controlling an actuation of an alarm 85 electrically connected to the alarm integrated circuit 81, a power source having at least a battery 82 stored in the battery chamber **1*e* and having two poles of the power source 82 electrically connected to the alarm integrated circuit 81, a wire-rope input lead 83 electrically connected between the alarm integrated circuit 81 and the wire rope 21 of the wire means 2 through a rotary connector 25 whereby the cutting of the wire rope 21 will input a signal into the alarm integrated circuit 81 through the wire-rope input lead 83 to actuate the alarm 85 for alarming, a vibration sensor 84 having a vibration input lead 842 of the sensor 84 electrically connected to the alarm integrated circuit 81 whereby a vibration of the wire lock will also input a signal into the alarm integrated circuit 81 through the vibration input lead 842 to actuate the alarm 85 for warning, and an indicator lamp 86 selected from a light-emitting-diode (LED) and a bulb which is operatively lit to indicate the alarm circuit 8** being alert ready for warning purpose.

The battery of the power source 82 is stored in the battery chamber **1*e* which is covered by the battery cover 1*c* having a packing pad 1*d* adhered on an inside surface of the battery cover 1*c*** for prevent from noise or unstable loading of the battery in the casing.

Figure 3:
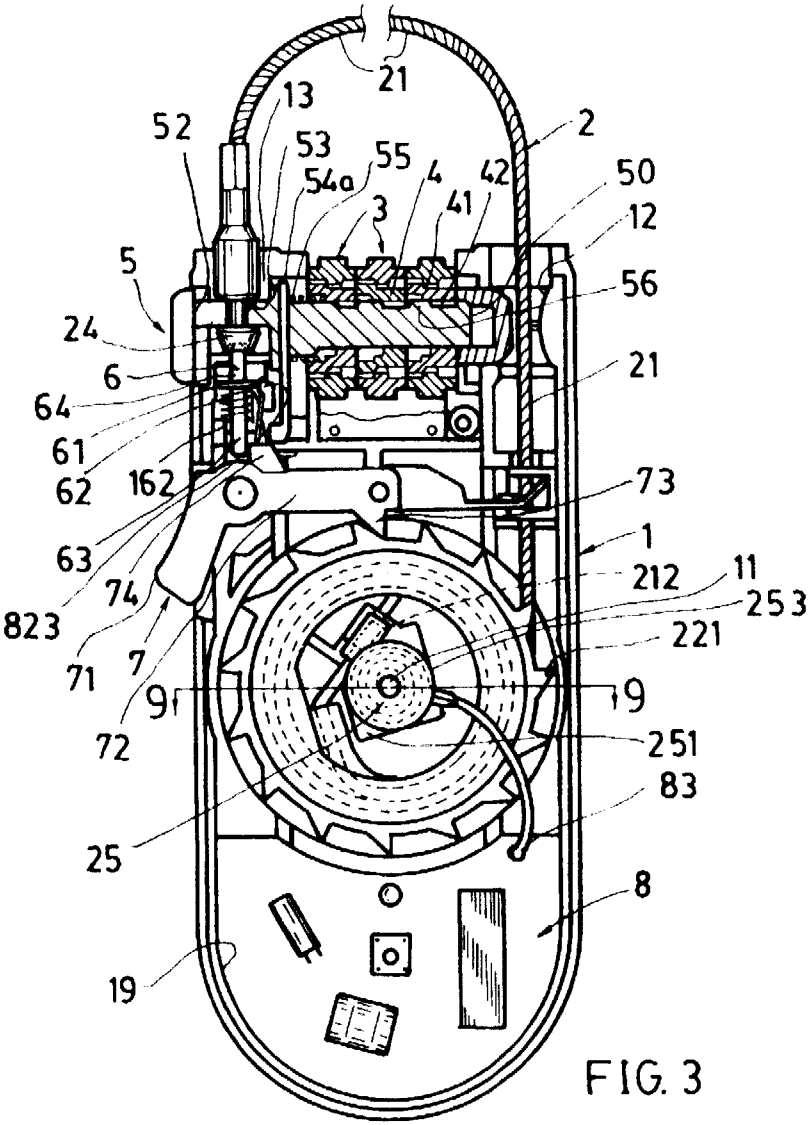
FIG. 3 is a sectional drawing of the present invention when locked by pulling the wire rope outwardly from FIG. 2, also closing the alarm circuit ready for alarming.
Figure 2:
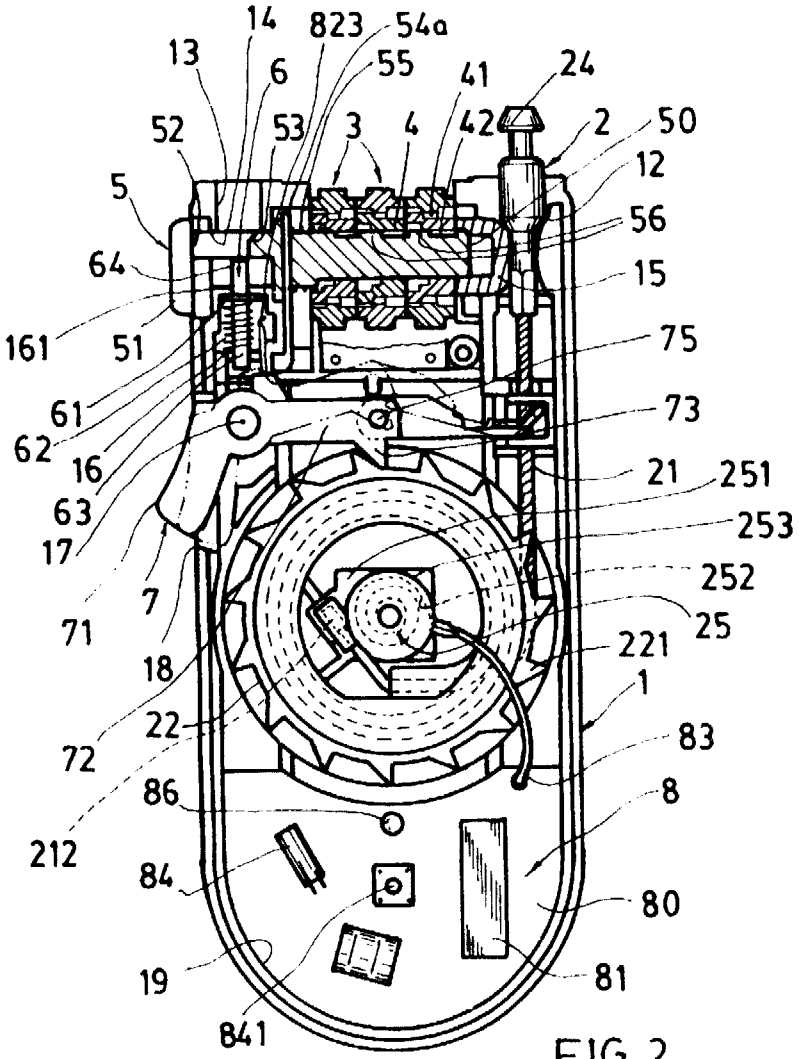
FIG. 2 is a sectional drawing of the present invention when the wire is not extended from the lock.

The wire rope 21 is made of electrically conductive material and the locking head 24 secured on the end of the wire rope 21 is pulled outwardly from the right hole 12 to the left hole 13 to be locked therein as from FIG. 2 to FIG. 3 to downwardly depress the impinger 6, which is also electrically conductive, to allow the flange 61 of the impinger 6 and the tensioning spring 62, which is electrically conductive, to contact a contactor switch 823 respectively connected to a negative pole of the power source 82 and connected to a negative-pole input lead 824 electrically connected to the alarm integrated circuit 81, with the power source 82 having its positive pole 821 electrically connected to the alarm integrated circuit 81 as shown in FIGS. 3, 8, whereby upon locking of the locking head 24 with the latch 5, the alarm circuit 8 is closed; and upon cutting of the wire rope 21 by a thief, the wire-rope input lead 83 will input a voltage change signal into the alarm integrated circuit 81 to actuate the alarm 85 for a sounding warning if the alarm 85 is formed as a buzzer.

When the wire lock is unlocked to eject the locking head 24, the wire 21 is disconnected from the contactor switch 823 to open the alarm circuit 8 to stop the actuation of the alarm 85.

Figure 7:
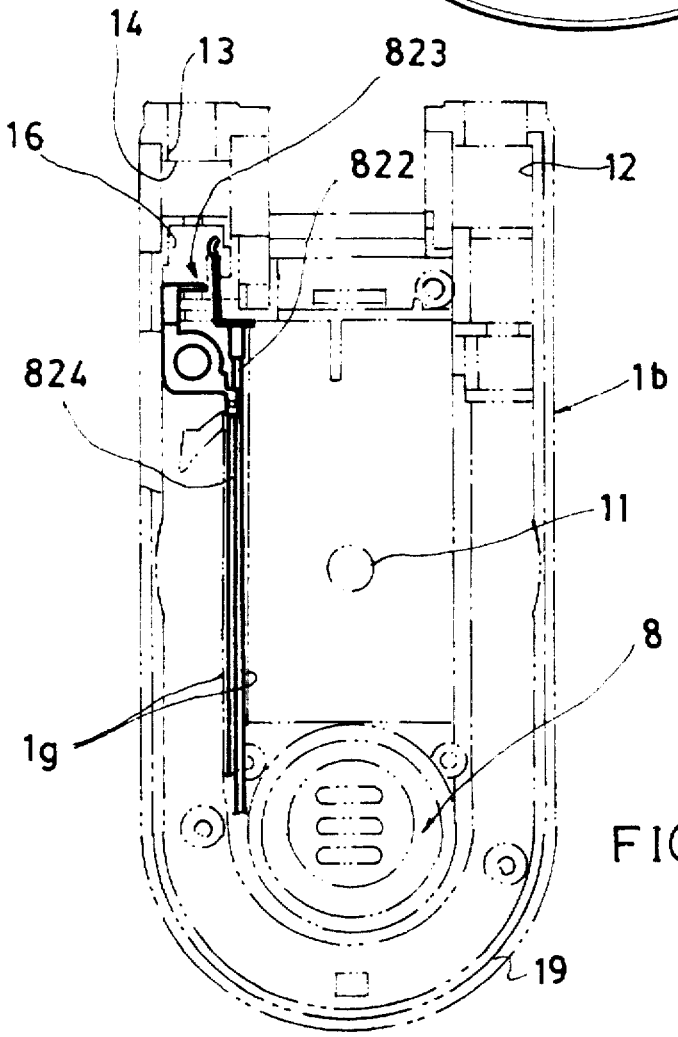
FIG. 7 shows electric lead wires of the alarm circuit embedded in a rear cover of the present invention.

As shown in FIG. 7, a groove **1*g* is longitudinally recessed in the rear cover 1*b* for embedding two leads 822, 824 of the contactor switch 823 into the groove 1*g***.

Figure 9:
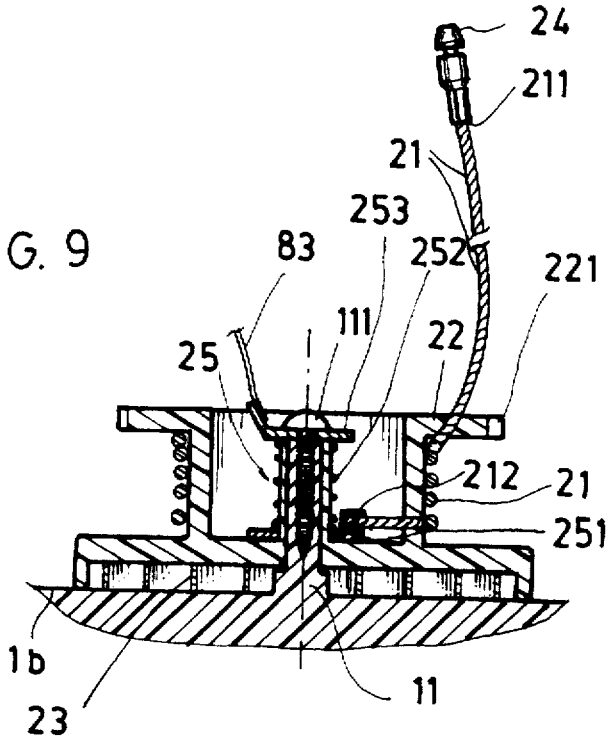
FIG. 9 is a sectional drawing of the wire means of the present invention.

The rotary connector 25 for connecting the wire rope 21 and the input lead 83 as shown in FIGS. 9, 3 includes: an electrically conductive bottom disk 251 rotatably mounted on the spindle 11 of the casing 1 and electrically connected to an innermost end 212 of the wire rope 21 by welding or soldering, an electrically conductive tension spring 252 disposed around the spindle 11 having a bottom spring end of the tension spring 252 rotatably slidably contacting the bottom disk 251, and an electrically conductive top disk 253 connected with the wire-rope input lead 83 and fixed on a top of the spindle 11 by a screw 111 to rotatably slidably contact an upper spring end of the tension spring 252 to be electrically connected with the wire rope 21.

Figure 6:
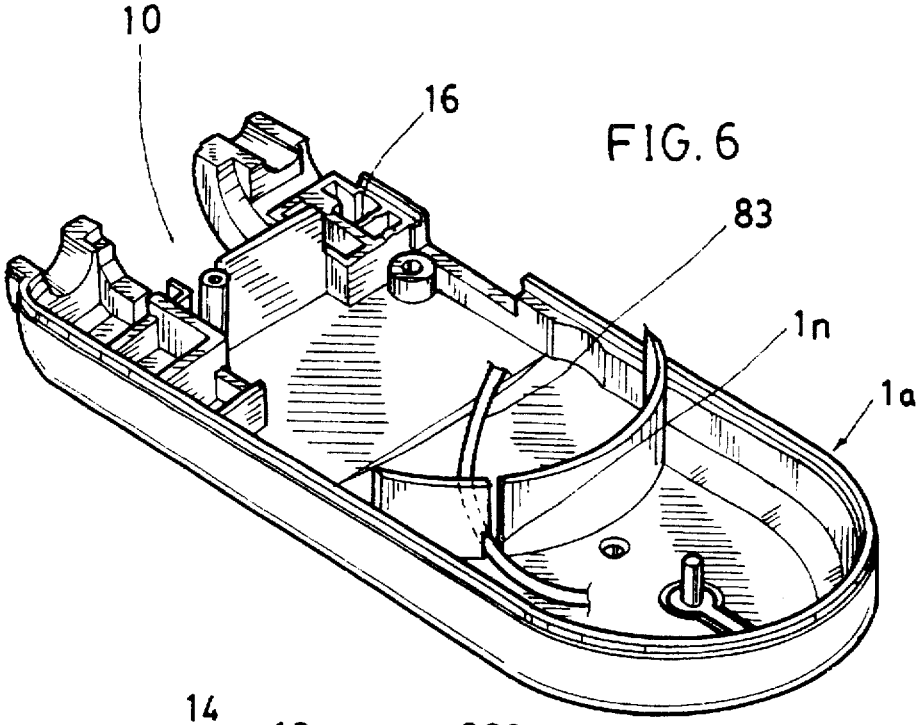
FIG. 6 is a perspective view of a front cover of the present invention.

The wire-rope input lead 83 is bridged over the top disk 253 and the reel 22 to be clamped or embedded in a slot in formed in the front cover la to prevent from tangling or breaking by the wire rope 21 as unwound from the reel 22 as shown in FIG. 6.

The battery cover **1*c* is formed with a hook recess 1*s* for engaging a hook portion 541 protruding from the retarding plate 54*a* to thereby lock the battery cover 1*c* on the rear cover 1*b* of the casing 1 when the wire lock is locked by engaging the push-button latch 5 with the locking head 24 to thereby prevent a retraction of the hook portion 541 in order for locking the battery cover 1*c*, whereby upon locking of the wire lock to prevent the depression of the push-button latch 51, the battery cover 1*c*** is simultaneously locked to prevent from removing the battery when trying to stop the alarm sounding by a thief.

The vibration sensor 84 may be a spring switch, a mercury switch or other switches actuated by vibrations, with the sensor 84 electrically connected to the alarm integrated circuit 81 by a vibration input lead 842 and connected to a sensor switch 841 having its negative-pole grounded.

Upon actuation of the sensor switch 841 of the vibration sensor 84, an indicator lamp 86 will be lit and a time-delay circuit (not shown) will be actuated to delay the action of the alarm 85 in a predetermined time interval (for instance, 4 seconds).

Once moving the wire lock such as by a thief to cause vibration therefor, a voltage change signal will be input into the alarm integrated circuit 81 through the input lead 842 to actuate the alarm 85 for warning purpose.

The locking and unlocking operation of the present invention is similar to that of the original invention (U.S. Pat. No. 4,896,517).

When the present invention is locked, the locking head 24 of the wire means 2 is pulled leftwardly to be inserted through the left hole 13 to thrust an upper inclined surface of the extension 53 to urge the latch 5 rightwardly and to depress the impinger 6 downwardly when the dials 3 are rotated to their unlocking combination. After the locking head 24 is downwardly moved to pass the extension 53 of the latch 5, the restoring spring 55 will restore the latch 5 leftwardly to lock the locking head 24, and the dials 3 are rotated to a locking condition to deviate each recess 42 of the sleeve 4 from the key or protrusion 56 of the latch 5 so that a depression of the push button 51, the latch 5 is not retracted rightwardly as obstructed by each sleeve 4 for locking the wire lock. The impinger 6 as downwardly depressed by the locking head 24 will close the contactor switch 823 to close the alarm circuit 8 ready for alert use.

For unlocking the wire lock of the present invention, the dials are rotated to an unlocking combination to allow each recess 42 of each sleeve 4 to engage each protrusion 56 of the latch 5, whereby upon a depression of the push button 51 to retract the extension 53 of the latch 5 rightwardly to disengage the locking head 24, the impinger 6 as urged by the spring 62 will resiliently eject the locking head 24 upwardly beyond the hole 13 and a coil spring 23 of the wire means 2 will rewind the wire rope 21 onto the reel 22 until the wire rope 21 is withdrawn rightwardly to keep the locking head 24 in the right hole 12. During the rewinding of wire rope, the ratchet teeth 221 are rotatably slipping from the pawl 73 for a rotation of the reel 22 for retracting the wire rope 21 within the casing 1. If for further pulling the wire rope 21 outwardly from the casing 1, the button 71 is depressed to bias the lever 72 upwardly to disengage the pawl 73 from the ratchet teeth 221 for pulling the locking head 24 outwardly in order for further locking the locking head 24 into the left hole 13.

When the wire lock is locked and upon a cutting of the wire rope 21, a voltage change signal will be input into the IC through the lead 83 to actuate the alarm 85 for its sounding warning. When the sensor switch 841 of the vibration sensor 84 is switched on and upon a vibration of the wire lock such as when moved by the thief, the sensor 84 will also produce a signal to trigger the IC to actuate the alarm 85 for anti-burglar purpose or for preventing stealing.

The present invention provides an alarm device based on the originally invented wire lock to enhance the security function of a wire lock.

The present invention may be modified without departing from the spirit and scope of the present invention.

I claim:

1. An alarming wire lock comprising: a casing (1) having a front cover (1*a*) combined with a rear cover (1*b*) for forming the casing, and having a right hole (12) and a left hole (13) respectively formed in an upper right and left portion of said casing;

a wire means (2) having a wire rope (21) wound on a reel (22) rotatably mounted in said casing and a locking head (24) secured on an outermost end of the wire rope (21) to be rested in the right hole when the wire lock is unlocked, with the locking head locked in the left hole when the wire lock is locked;

a plurality of dials (3) and sleeves (4) rotatably mounted in said casing;

a push-button latch (5) transversely mounted in said casing and slidably engageable with said sleeves resiliently coupled with said dials, said latch (5) engageable with said locking head (24) when locked in the left hole in said casing;

a resilient impinger (6) movably held in a left portion of said casing for resiliently ejecting said locking head (24) of said wire means when unlocked;

a wire clutch means (7) pivotally mounted in said casing for controlling a rewinding of said wire rope (21) on said reel (22) and controlling a releasing of said wire rope (21) unwound from said reel (22), said wire clutch means (7) operatively locked by said impinger (6) when downwardly depressed by said locking head (24) when the wire lock is locked; and an alarm circuit (8) having an alarm (85) provided in said casing (1), said alarm (85) operatively actuated upon a cutting of the wire rope (21) or upon a vibration of said casing (1);

said alarm circuit (8) including: an alarm integrated circuit (81) secured on a circuit board (80) installed in the casing (1) for processing an input alarm signal and for controlling an actuation of said alarm (85) electrically connected to the alarm integrated circuit (81), a power source having at least a battery (82) stored in a battery chamber (1)formed in said casing and having two poles of the power source (82) electrically connected to the alarm integrated circuit (81), a wire-rope input lead (83) electrically connected between the alarm integrated circuit (81) and the wire rope (21) of the wire means (2) through a rotary connector (25) whereby the cutting of the wire rope (21) will input a first signal into the alarm integrated circuit (81) through the wire-rope input lead (83) to actuate the alarm (85) for alarming, a vibration sensor (84) having a vibration input lead (842) of the sensor (84) electrically connected to the alarm integrated circuit (81) whereby a vibration of the wire lock will input a second signal into the alarm integrated circuit (81) through the vibration input lead (842) to actuate the alarm (85) for warning, and an indicator lamp (86) indicating the alarm circuit (8) being ready for warning.

2. An alarming wire lock according to claim 1, wherein said wire rope (21) is made of electrically conductive material and the locking head (24) being electrically conductive, said impinger (6) having a flange (61) formed on a middle portion of the impinger (6) and a tensioning spring (62), which is electrically conductive, resiliently tensioning the flange (61) upwardly, whereby when the locking head (24) is locked into the left hole (13) in the casing, the impinger (6) is depressed downwardly to contact a contactor switch (823) respectively connected to a negative pole of the power source (82) and connected to a negative-pole input lead (824) electrically connected to the alarm integrated circuit (81), with the power source (82) having a positive pole (821) thereof electrically connected to the alarm integrated circuit (81), whereby upon locking of the locking head (24) with the push-button latch (5), the alarm circuit (8) is closed; and upon cutting of the wire rope (21), the wire-rope input lead (83) will input a voltage change signal into the alarm integrated circuit (81) to actuate the alarm (85) for warning.

3. An alarming wire lock according to claim 1, wherein said rotary connector (25) for connecting the wire rope (21) and the input lead (83) includes: an electrically conductive bottom disk (251) rotatably mounted on a spindle (11) of said reel (22) in the casing (1) and electrically connected to an innermost end (212) of the wire rope (21), an electrically conductive tension spring (252) disposed around the spindle (11) having a bottom spring end of the tension spring (252) rotatably slidably contacting the bottom disk (251), and an electrically conductive top disk (253) connected with the wire-rope input lead (83) and fixed on a top of the spindle (11) to rotatably slidably contact an upper spring end of the tension spring (252) to be electrically connected with the wire rope (21).

4. An alarming wire lock according to claim 3, wherein said wire-rope input lead (83) is bridged over the top disk (253) and the reel (22) to be embedded in a slot formed in a front cover (1*a*) to said casing (1) to prevent from tangling by the wire rope (21) from the reel (22).

5. An alarming wire lock according to claim 1, wherein said battery of said power source is stored in a battery chamber formed in a rear cover of said casing, having a battery cover (1*c*) for covering said battery chamber, said battery cover (1*c*) formed with a hook recess for engaging a hook portion (541) protruding from a retarding plate (54*a*) formed on said push-button latch (5) to thereby lock the battery cover (1*c*) on the rear cover of the casing (1) when the wire lock is locked by engaging the push-button latch (5) with the locking head (24) to thereby prevent retraction of the hook portion (541) in order for locking the battery cover (1*c*).

6. An alarming wire lock according to claim 1, wherein said vibration sensor (84) is selected from: a spring switch, a mercury switch and switches, which are triggered by vibration, for actuating said alarm (85), with the sensor (84) electrically connected to the alarm integrated circuit (81) by an vibration input lead (842) and connected to a sensor switch (841) having a negative-pole of said sensor switch (841) grounded.

7. An alarming wire lock according to claim 6, wherein said vibration sensor (84) includes: time-delay circuit which is actuated to delay the actuation of the alarm (85) in a predetermined time interval.

* * * * *